US010569981B2

(12) United States Patent
Sawicki et al.

(10) Patent No.: US 10,569,981 B2
(45) Date of Patent: Feb. 25, 2020

(54) ACTIVE REGISTRATION SYSTEM UTILIZING FORCED AIR FOR EDGE REGISTRATION

(71) Applicant: Xerox Corporation, Norwalk, CT (US)

(72) Inventors: Paul F. Sawicki, Rochester, NY (US); John R. Uchal, Webster, NY (US); James E. Williams, Penfield, NY (US); Robert W. Phelps, Victor, NY (US); Christopher Douglas Atwood, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/939,809

(22) Filed: Mar. 29, 2018

(65) Prior Publication Data

US 2019/0300315 A1 Oct. 3, 2019

(51) Int. Cl.

| | |
|---|---|
| ***B65H 9/10*** | (2006.01) |
| ***B65H 9/04*** | (2006.01) |
| ***B65H 9/20*** | (2006.01) |
| *B65H 9/00* | (2006.01) |

(52) U.S. Cl.

CPC ..... *B65H 9/108* (2013.01); *B65H 9/04* (2013.01); *B65H 9/20* (2013.01); *B65H 9/00* (2013.01); *B65H 2406/122* (2013.01)

(58) Field of Classification Search

CPC . B65H 9/00; B65H 9/10; B65H 9/103; B65H 9/105; B65H 9/108; B65H 2406/12; B65H 2406/121; B65H 2406/1211; B65H 2406/122; B65H 2406/1222; B65H 2406/13; B65H 2406/131; B65H 2406/14

USPC ..... 271/248, 250, 251, 249, 252

See application file for complete search history.

(56) References Cited

U.S. PATENT DOCUMENTS

| | | | | |
|---|---|---|---|---|
| 4,113,247 | A * | 9/1978 | Phillips | B65H 5/222 193/38 |
| 4,621,801 | A | 11/1986 | Sanchez | |
| 4,836,527 | A | 6/1989 | Wong | |
| 7,140,606 | B2 * | 11/2006 | Suga | B65H 3/48 271/97 |
| 7,374,164 | B2 * | 5/2008 | Gaissert | B65H 9/163 271/197 |
| 7,392,981 | B2 * | 7/2008 | Hahn | B65H 3/0825 271/195 |
| 8,020,858 | B2 | 9/2011 | deJong et al. | |
| 8,272,732 | B2 * | 9/2012 | Yanagi | B41M 5/0017 347/101 |

* cited by examiner

*Primary Examiner* — Jeremy R Severson
(74) *Attorney, Agent, or Firm* — Fay Sharpe LLP

(57) ABSTRACT

A media handling assembly contains a transport path for driving a document sheet downstream in a process direction. A first side edge extends lengthwise along the process direction. A registration guide edge extends lengthwise along the process direction and is situated opposite the first side edge. The media handling assembly includes at least one nozzle that is arranged proximate the first side edge. The at least one nozzle selectively discharges an airstream transverse the process direction towards the registration guide edge. The airstream drives the sheet against the registration edge guide for side registering and deskewing of the sheet.

16 Claims, 4 Drawing Sheets

ACTIVE REGISTRATION SYSTEM UTILIZING FORCED AIR FOR EDGE REGISTRATION

BACKGROUND

The present disclosure is directed to a side registration system and method for accurately registering a sheet in a media handling assembly using forced air. While the registration system particularly relates to the commercial printing of heavy media stock, it is amendable to other types of media.

In media handling assemblies, particularly in printing systems, accurate and reliable registration of the substrate media is desirable as it is transferred in a process direction. In particular, accurate registration of the substrate media, such as a sheet of paper, as it is delivered to an image transfer zone will improve the overall printing process. The sheet is generally conveyed within the system in a process direction. However, often the sheet can shift in a cross-process direction that is lateral to the process direction, or it may acquire an angular orientation—referred to herein as "skew"—meaning that its opposed linear edges are no longer parallel to the process direction. Thus, the sheet can move in three degrees of freedom, which need to be controlled in order to achieve accurate delivery of the sheet.

A slight skew, lateral misalignment or error in the arrival time of the substrate media can lead to errors, such as image and/or color registration errors. Also, the amount of skew can increase or accumulate as the substrate media is transferred between sections of the media handling assembly.

Conventional registration systems steer, straighten and guide sheets in a printing zone so that the images square up and register on the sheet properly. These systems—referred to as differentially driven drive or nip assemblies—employ a series of rollers that push the sheet forward in response to edge sensors that guide the sheet. More specifically, these systems attempt to register sheets by separately varying the speeds of the spaced apart drive rollers, which are controlled in response to sensor measurements to correct for skew mispositioning of the sheet. FIG. 1 shows a conventional sheet registration system according to the PRIOR ART. The registration system 8 consists of two sets of drive nip assemblies 20, 30. Each nip assembly 20, 30 includes a driven wheel 22, 24 (also referred to as drive rolls) and an idler wheel 26, 28, (also referred to as idler rolls) which together engage opposed sides of the sheet S and conveying it within the printing system in a process direction P. Also included are separate drive motors and/or belt assemblies 21, 23 for imparting an angular velocity to the driven wheels 22, 24. The motor may be connected directly to the driven wheels 22, 24 using a common idler shaft 25, although belts 21, 23 are often employed. The registration system 8 also includes sheet leading edge sensors 48, 50, which detect the arrival of a sheet. The sequence of arrival between the different sensors 48, 50 is also used to measure rotational mispositioning (skew) of the sheet. By temporarily driving two motors at slightly different rotational speeds, the conventional registration system provides a slight difference in the total rotation or relative pitch position of each drive roll 22, 24 while the sheet is held in the two nips 20, 30. One side of the sheet is temporarily moved ahead of the other to induce a skew (small partial rotation) in the sheet, i.e., opposite from an initially detected sheet skew in order to eliminate and correct for the detected skew.

FIG. 2 shows another conventional sheet registration system, which also includes two spaced apart nip assemblies

20, 30 and a common idler shaft 25. Skew is corrected by a controller 60 prescribing differentially driven nips 20, 30 for a short period of time while the sheet S is engaged by the nips 20, 30. The sheet arrival time and skew are measured by sensors 48, 50 that are disposed along a sensor line 41 that extends perpendicular to the process direction P. While the nip velocities are varied in these conventional systems, the average velocity between both nips must always equal the desired forward velocity of the sheet in order to maintain process speeds. A difference between the nip velocities will temporarily impart an angular velocity to the sheet used to correct skew.

However, the registration systems implemented in conventional media handling assemblies were designed to process a maximum sheet length of 26-inches. The conventional nip or pinch rollers are not suited for handling larger scale printing jobs that require longer and/or heavy weight stock, s.a., signage, posters, and banners, etc. Existing rollers do not work well on sheets that are longer the current maximum of 26-inches. The rollers end up fighting against each other in a tug-of-war operation. A substantial skew can cause pushing, pulling or shearing forces, which can wrinkle, buckle or even tear the sheet.

Therefore, projects that are printed on heavy weight stock or in larger format require specialized printers that are located at a commercial print shop. A media handling assembly is desired which would allow users to handle commercial printing and signage projects in a noncommercial setting. Accordingly, an improved registration system is desirable for straightening longer and/or heavy weight media, and a method of accurately registering a sheet in a media handling assembly, which overcomes the shortcoming of the prior art.

While the exemplary embodiment is particularly directed to the art of digital image processing, and will be thus described with specific reference thereto, it will be appreciated that the exemplary embodiment may have usefulness in other fields and applications.

BRIEF DESCRIPTION

One embodiment of the disclosure is directed to a side registration system for a media handling assembly. The side registration system registers and deskews a document sheet that is being driven downstream in a process direction in the media handling assembly. The side registration system includes a first side edge extending lengthwise along the process direction. The side registration system includes a registration guide edge extending lengthwise along the process direction and which is situated opposite the first side edge. The side registration system also includes a transport path situated between the first side edge and the registration guide edge. The side registration system includes at least one nozzle that is arranged proximate the first side edge. Each of the nozzles selectively discharge an airstream transverse the process direction. The airstream drives the sheet against the registration edge guide as the sheet is transported along the transport path.

Another embodiment of the disclosure is directed to a media handling assembly. The media handling assembly contains a transport path for moving a document sheet downstream in a process direction. A first side edge extends lengthwise along the process direction. A registration guide edge extends lengthwise along the process direction and is situated opposite the first side edge. The media handling assembly includes at least one nozzle that is arranged proximate the first side edge. Each of the nozzles selectively discharges an airstream transverse the process direction. The airstream drives the sheet against the registration edge guide for side registering and deskewing of the sheet.

BRIEF DESCRIPTION OF THE DRAWINGS

The present disclosure is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and drawing.

DETAILED DESCRIPTION

Figure 1:
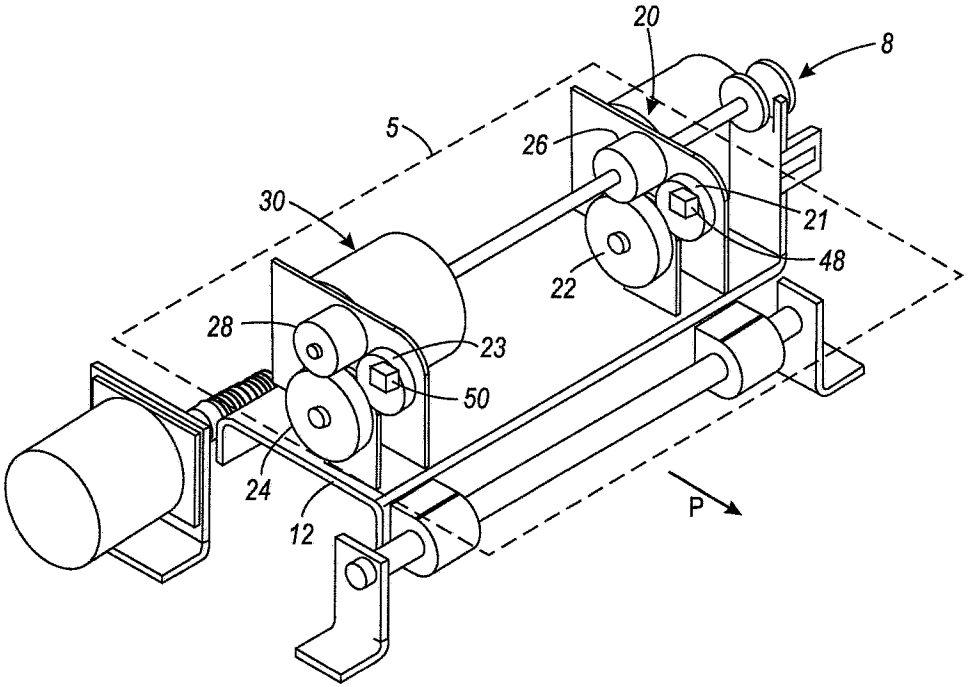
FIG. 1 Prior Art
FIG. 1 shows a conventional sheet drive-and-nip registration system according to the PRIOR ART.
Figure 2:
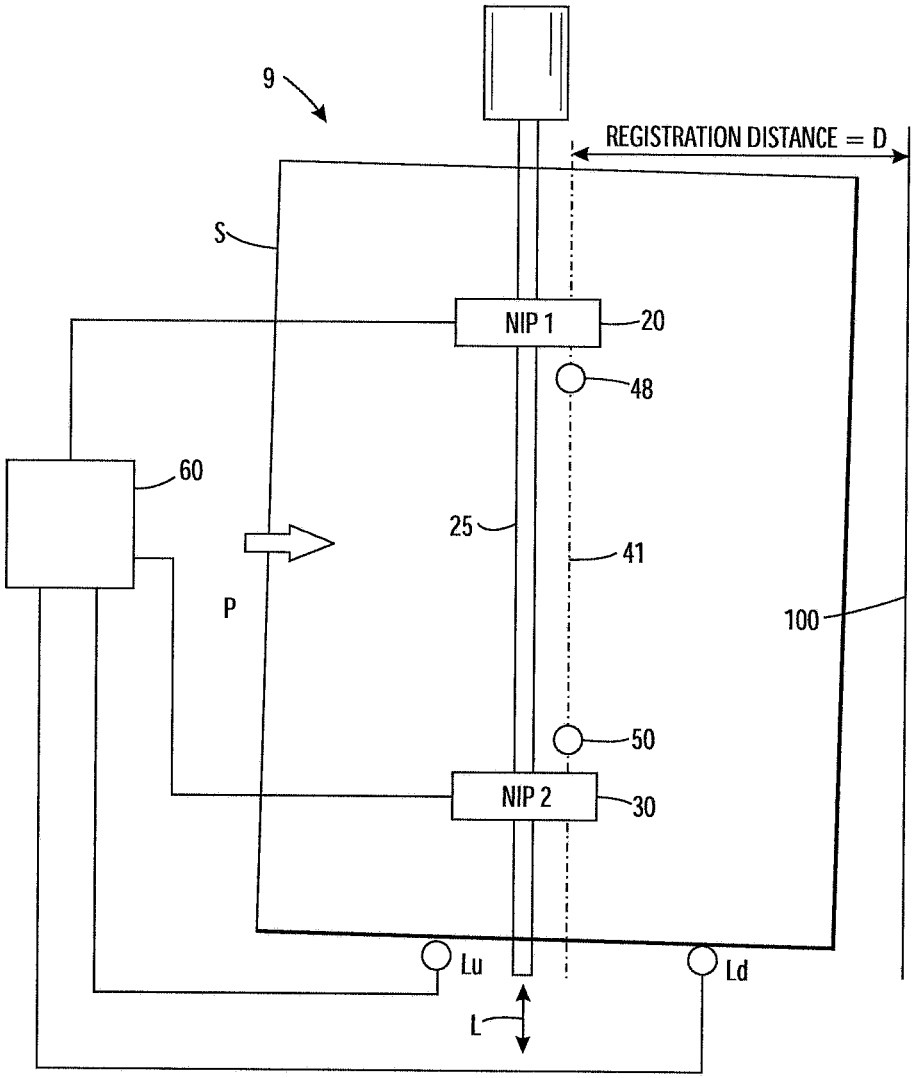
FIG. 2 Prior Art
FIG. 2 shows another conventional sheet drive-and-nip registration system according to the PRIOR ART.

The present disclosure is directed to a forced air registration system employs air jets to register and deskew a document.

Describing now in further detail these exemplary embodiments with reference to the Figures, as described above the accurate sheet leading edge registration system and method are typically used in a select location or locations of the paper path or paths of various conventional media handling assemblies. Thus, only a portion of an exemplary media handling assembly path is illustrated herein.

As used herein, a "media handling assembly" refers to one or more devices used for handling and/or transporting substrate media, including feeding, printing, finishing, registration and transport systems.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. As used herein, the "side edge" of a substrate media refers to an edge of the sheet that extends along the process direction. As used herein "heavy weight stock" can refer to thicker or longer substrates, generally over 26-inches.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of moving, transporting and/or handling a substrate media. The process direction is a flow path that the substrate media moves in during the process. A "cross-process direction" is perpendicular to the process direction and generally extends parallel to the web of the substrate media.

Existing media handling assemblies generally process ANSI standard paper sizes. However, the side registration system disclosed herein is operative to handle longer sheets (e.g., 45, 47, and 73 inches or longer). In other words, one aspect of the present disclosure is that it can be used to process sheets having longer length (e.g., a banner) and/or width (e.g., posters) dimensions, which would normally cause malfunctions in a conventional printer. The present side registration system allows for larger scale commercial print projects to be handled in an office setting, whereby such system can handle heavy weight stock.

Figure 3:
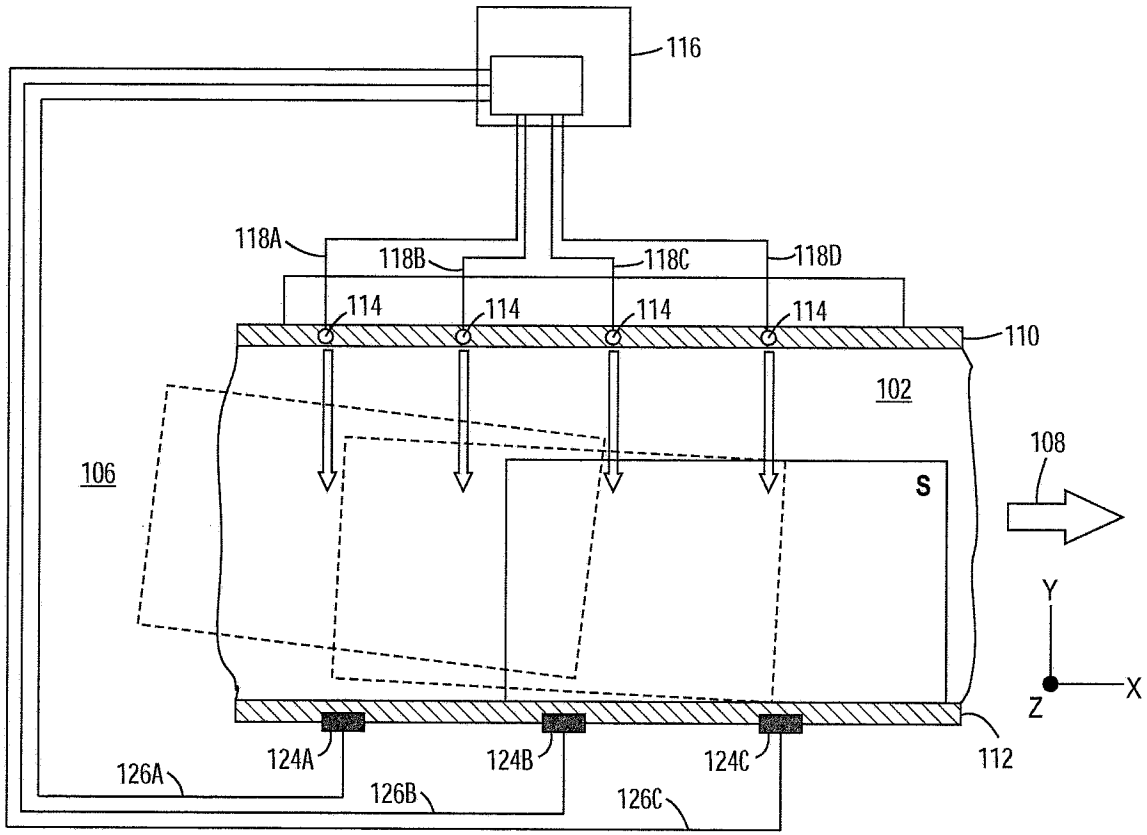
FIG. 3 shows a partially schematic plan view of a side registration system for registering a sheet handled in a printing system.

FIG. 3 depicts a partially schematic plan view of a side registration system 100 for registering a sheet that is being handled in a media handling assembly. It should be noted that the partially schematic drawings herein are not to scale. A coordinate system with X-Y-Z axes is shown for ease of reference. In general, the X axis corresponds to the process direction or direction of travel downstream and the Y-axis to the cross machine airflow direction, while the Z direction extends above and below the media substrate S. As shown, the side registration system 100 includes a document feeding path 102.

The side registration system 100 includes the document feeding path 102 (also referred to herein as document transport) to drive the substrate S downstream in the process direction. For example, the document feeding path 102 generally carries sheets from a document feeder to an image applying component; from the image applying component to a finishing device; and/or from a finishing device to an output tray. There is no limitation made herein to upstream and downstream mechanisms. For illustrative purposes, the disclosure is described with reference to a document feeding path 102 that is transporting heavy weight and/or longer substrate media S from a document feeder (not shown) to an image applying component (not shown).

Conventional registration systems may include a platen transport that employs a single or plural transport belts or feed wheels—utilizing frictional, vacuum, or electrostatic sheet driving forces. In the contemplated embodiment, such mechanisms are absent. In the contemplated embodiment, the document feeding path is defined by a smooth, flat plate.

Continuing with FIG. 3, the document feeding path 102 is defined by an entry 106 and an exit 108. The document feeding path 102 is further defined by a first side edge 110 that extends lengthwise along the process direction and a registration guide edge 112 that also extends lengthwise along the process direction. The registration guide edge 112 is situated opposite the first side edge 110. In the contemplated embodiment, the first side edge 110 and the registration guide edge 112 extend at least to a feeder of the next downstream component, such as the image applying component.

Absent in the disclosed embodiment are nip rollers that deskew and register the document as it is driven downstream. The current embodiment rather employs a plurality of nozzles 114 (herein also referred to as "jets") to straighten a sheet using a jet of air. The nozzles 114 are in successive arrangement proximate the first side edge 110. In one embodiment, the nozzles 114 are situated proximate a portion of the first side edge 110 at least covering a length of expected substrate S. The nozzles 114 can be situated in an equal spaced arrangement, although embodiments are also contemplated where the nozzles are not equally spaced apart. For example, the spacing between successive nozzles can decrease toward the exit 108 of the transport path 102. In other words, successive nozzles can get closer together along the process direction. Alternately, successive nozzles can get farther apart along the process direction. Further, the nozzles can be situated in the same plane, although embodiments are also contemplated where alternating nozzles are offset, or every predetermined numbered $n^{th}$ nozzle is offset in a different plane.

In one embodiment, the first side edge 110 is a fixed wall that extends upwardly from a longitudinal edge of the transport path 102. The nozzle heads 114 can be situated in the wall (FIG. 4) such that a plane in which the nozzles lie is slightly above the plane of the plate defining the transport path 102. The nozzle heads 114 generally face the edge registration guide 112 and, in one embodiment, can be angled slightly downward toward the transport path 102 to ensure that an airstream does not pass over and miss a moving substrate S without contacting the substrate S. In the preferred embodiment, the nozzle heads 114 are situated in a plane (i.e., at a height relative to the transport path 102) and/or angled in such a manner that the airstream appropriately hits the side of the fairly thick media.

In another embodiment, the nozzle heads 114 can be angled slightly downstream to discharge an airstream that simultaneously drives the substrate S downstream. Any combination of these orientations is contemplated. The nozzles can be throttled differently.

Each of the nozzles 114 is controlled to selectively discharge an airstream in the cross-process direction. In other words, the nozzles 114 discharge air in the y-axis and across the transport path 102, but can also simultaneously discharge air at an angle that moves the substrate S in both the x- and y-axes across and along the transport path. The air that is discharged by the nozzles 114 urge and force the moving substrate S against the edge registration guide 112.

In the contemplated embodiment, the registration edge guide 112 is a fixed side edge having a length that is greater than or equal to both a width and height of the heavy media stock S. The registration edge guide 112 is defined by a wall that extends upwardly from the transport path 102, and which acts as a stopper or wall for substrates S that are urged against it. In other words, the registration edge guide 112 prevents any further transverse movement of the substrate S as the substrate S continually moves downstream.

In the contemplated embodiment, an orientation of the substrate S—as it is driven down the transport path—is such that the shorter side of the substrate is the leading edge and the longer side of the substrate abuts the edge registration guide 112. To this extent, a length of the edge registration guide 112 is greater than a width of the transport path 102. When the substrate S is pushed against the edge registration guide 112, an orientation of the substrate S is straightened and deskewed for the next operation to be performed thereon downstream. The airstream continues as necessary to maintain the corrected position S until the substrate S exits the side registration system 100.

Continuing with FIG. 3, the side registration system 100 further includes a controller 116. In one embodiment, the jets are connected to the main controller that operates the media handling assembly. In an alternative embodiment, the jets 114 are connected to a single controller 11 that is different from the main controller and which is operative to impart the airstream against the substrate S using the nozzles.

In one embodiment, shown in FIG. 3, the nozzles 114 are connected to the controller 116 by links 118*a-d*, which may be a wired or wireless link for individual actuation. In other words, each nozzle 114 can be independently and selectively operated by the controller 116. In this manner, select nozzles 114 can discharge airstreams while other nozzles are shut off. In the contemplated embodiment, select nozzles can operate, for example, at differing levels of pressure. In other words, one nozzle 114 can operate at one pressure while a nozzle upstream or downstream is operating at a lower or higher pressure. The pressure can be adjust depending on, for example, the measurements received by a sensor, discussed later. The controller 116 includes a programmable processor. The coordinated operation of the controller 116 is achieved through a set of operating instructions (e.g., software) programmed into programmable processor.

Figure 4:
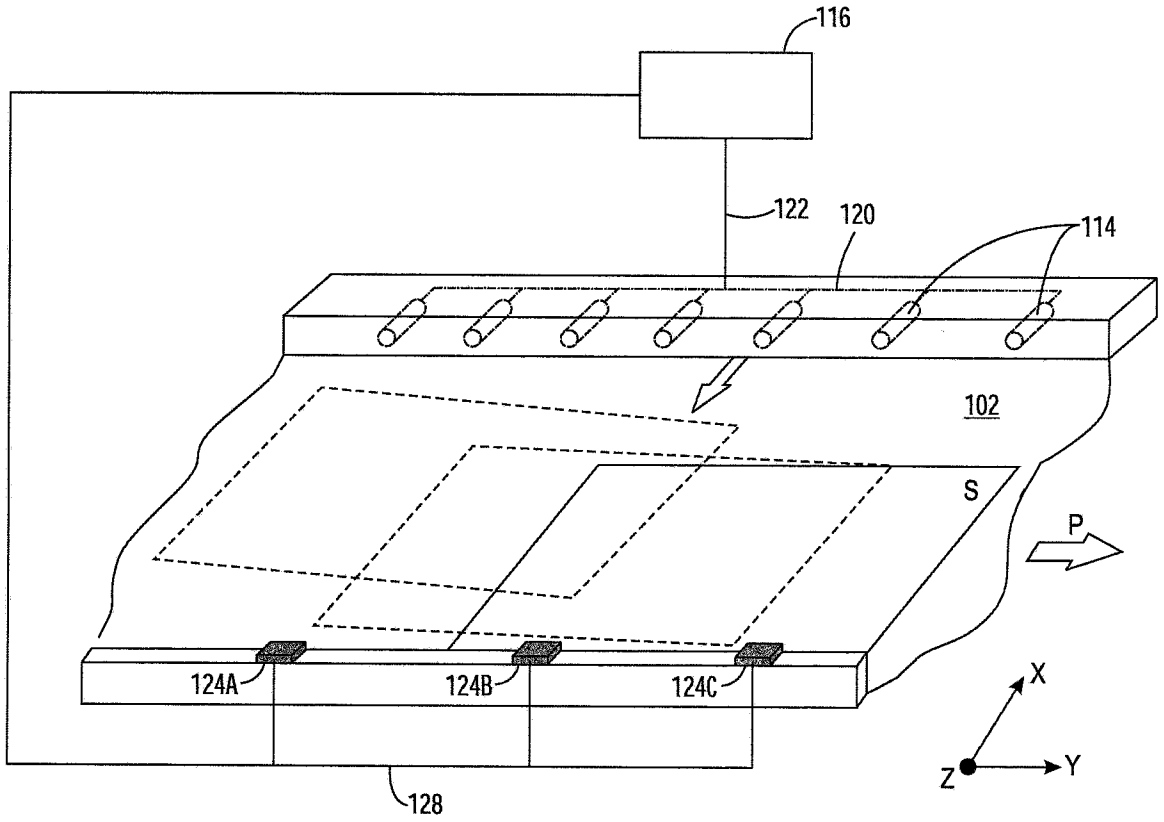
FIG. 4 shows a partially schematic perspective view of a side registration system for registering a sheet handled in a printing system.

In another embodiment, shown in FIG. 4, the nozzles 114 can belong to a common manifold 120 that is situated along a portion of the first side edge 110. In this embodiment, all the nozzles 114 contained in the manifold 120 discharge air in unison, and the nozzles uniformly respond to any adjustment made by the controller 116 to the air pressure. A shared wire or wireless link 120 connects the manifold 122 to the controller 116.

In one embodiment, the controller 116 can impart a continuous airstream at a moving substrate S. In another embodiment, the controller 116 can impart a pulsed airstream at the moving substrate S.

Continuing with FIGS. 3 and 4, the side registration system 100 also includes at least one registration edge sensor 124*a-c* in communication with the controller 116. There is no limitation made herein to the type of sensor that is employed by the system 100, or to its location. Mainly, at least one sensor 124*a-c* detects a position or location of the sheet. In one embodiment, the sensors are optical sensors that determine how skewed and/or straight a moving substrate S is.

In another embodiment, a different sensor (not shown)—as typically employed in conventional lead edge registration systems—detects a lead edge of the sheet for timing the print operation accordingly.

FIGS. 3 and 4 illustrate how air is forcing a sheet against the registration wall. The sheet S enters registration system 100 at the entry 106 of the transport path 102. In the contemplated embodiment, a vacuum head (not shown) is employed to pull the sheet S from a feeder tray and move it to the transport path 102. The sheets S can be crooked when they are delivered onto the transport path 102. FIGS. 3 and 4 illustrate a sheet S that requires straightening at the beginning of the transport path 102. The sheet S is shown to have a crooked orientation as it starts moving in the primary direction of flow P downstream.

Without a registration system, the amount of skew can accumulate as the sheet S is transported from the feeder tray to the next processing device. However, as the nozzles 114 discharge air in the cross-process direction, the sheet S is forced against the edge registration guide 112. FIGS. 3 and 4 illustrate the sheet S starting to straighten out as the jets of air are applied to it. The jets of air are applied to the sheet S until the long side of the sheet is in complete contact with the edge registration guide 112. FIGS. 3 and 4 show the sheet in the corrected position S before it exits the side registration system 100. The sheet S can enter the next device, such as the marking device, all squared.

Printing of heavy weight stock, s.a., signage, posters, and banners, etc. is conventionally outsourced by users to a facility having commercial equipment that is capable of handling the heavy weight stock. One aspect of the present side registration system is that it can be incorporated into a home or office media handling assembly that typically processes lightweight, standard sized media or sheets in a non-commercial setting.

Another aspect of the present side registration system is that it does not use wheels or guide rollers to push the sheet downstream, and therefore it eliminates any conflict between rollers in existing systems that would otherwise damage the media or cause a malfunction.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A side registration system for registering and deskewing a document sheet being driven downstream in a process direction in a media handling assembly, the system comprising:

a first side edge extending lengthwise along the process direction;

a registration guide edge extending lengthwise along the process direction, the registration guide edge situated opposite the first side edge;

a transport path situated between the first side edge and the registration guide edge;

at least one nozzle being arranged proximate the first side edge, each of the nozzles selectively discharging an airstream transverse the process direction;

a controller operative to impart the airstream against the sheet; and a registration edge sensor in communication with the controller, the sensor operative to detect a contact of the sheet with the registration guide edge;

wherein the airstream drives the sheet against the registration guide edge as the sheet is driven along the transport path.

2. The system of claim 1, wherein the at least one nozzle is located upstream from an image applying component.

3. The system of claim 1, wherein the registration guide edge is a fixed side edge having a length that is greater than or equal to both a width and height of the sheet.

4. The system of claim 1, wherein a length of the registration edge guide is greater than a width of the transport path.

5. The system of claim 1, wherein the airstream is a continuous airstream.

6. The system of claim 1, wherein the airstream is a pulsed airstream.

7. The system of claim 1, wherein the at least one nozzle belongs to a manifold situated along the first side edge.

8. The system of claim 1 further comprises at least two nozzles, wherein each nozzle is independently and selectively operated by the controller.

9. A media handling assembly, comprising:

a transport path driving a document sheet downstream in a process direction, a first side edge extending lengthwise along the process direction;

a registration guide edge extending lengthwise along the process direction, the registration guide edge situated opposite the first side edge;

at least one nozzle being arranged proximate the first side edge, the at least one nozzle selectively discharging an airstream transverse the process direction;

a controller operative to impart the airstream against the sheet; and a registration edge sensor in communication with the controller, the sensor operative to detect a contact of the sheet with the registration guide edge;

wherein the airstream drives the sheet against the registration guide edge for side registering and deskewing of the sheet.

10. The media handling assembly of claim 9, wherein the at least one nozzle is located upstream from an image applying component.

11. The media handling assembly of claim 9, wherein the registration guide edge is a fixed side edge having a length that is greater than or equal to both a width and height of the sheet.

12. The media handling assembly of claim 9, wherein a length of the registration guide edge is greater than a width of the transport path.

13. The media handling assembly of claim 9, wherein the airstream is a continuous airstream.

14. The media handling assembly of claim 9, wherein the airstream is a pulsed airstream.

15. The media handling assembly of claim 9, wherein the at least one nozzle belongs to a manifold situated along the first side edge.

16. The media handling assembly of claim 9, wherein each nozzle is independently and selectively operated by the controller.

* * * * *